United States Patent [19]

Erich et al.

[11] Patent Number: 5,036,606

[45] Date of Patent: Aug. 6, 1991

[54] LOCKING CLEAT AND RECEPTACLE SYSTEM

[75] Inventors: Thomas W. Erich, Holliston; Harris L. MacNeill; Paul A. Latraverse, both of Northborough, all of Mass.

[73] Assignee: MacNeill Engineering Company, Inc., Marlborough, Mass.

[21] Appl. No.: 400,343

[22] Filed: Aug. 30, 1989

[51] Int. Cl.[5] ..... A43B 5/00

[52] U.S. Cl. ..... 36/134; 36/67 D

[58] Field of Search ..... 36/134, 67 D, 67 R, 36/67 A

[56] References Cited

U.S. PATENT DOCUMENTS

| | | | |
|---|---|---|---|
| 817,977 | 4/1906 | Leibert | 36/67 A |
| 2,026,280 | 12/1935 | Kerin | 36/67 D |
| 2,192,150 | 2/1940 | Pierce et al. | 36/67 D |
| 2,689,417 | 9/1954 | Bernstein | 36/67 D |
| 3,487,563 | 6/1970 | Austin | 36/67 D |
| 4,723,366 | 2/1988 | Hagger | 36/67 D |

FOREIGN PATENT DOCUMENTS

| | | | |
|---|---|---|---|
| 0061715 | 10/1982 | European Pat. Off. | 36/134 |
| 2851535 | 4/1980 | Fed. Rep. of Germany | 36/134 |

OTHER PUBLICATIONS

United Kingdom Application 2115683A, Sep.-1983.

*Primary Examiner*—Paul T. Sewell
*Assistant Examiner*—Ted Kavanaugh
*Attorney, Agent, or Firm*—Bromberg & Sunstein

[57] ABSTRACT

A traction cleat, in one embodiment, has a cylindrical cuff disposed concentrically around the screw or other arrangement for engaging the cleat in the receptacle. The cylindrical cuff includes one or more axially orientated splines disposed on its inner or outer surface. Such a cleat may be attached to the shoe utilizing a receptacle that, in one embodiment, has a cylindrical ring disposed concentrically around the cleat receiving portion of the receptacle. The cylindrical ring has one or more axially oriented splines disposed on one of the rings inner or outer surfaces in such a fashion as to be able to mesh with the spline or splines on the mated cleat.

10 Claims, 4 Drawing Sheets

LOCKING CLEAT AND RECEPTACLE SYSTEM

DESCRIPTION

1. Technical Field

This invention relates to traction cleats and receptacles for shoes, and in particular to cleats suitable for sports and field use.

2. Background Art

The present invention is an improvement on conventional traction cleats and receptacles, which are well known in the art. The improvement is applicable to the traction cleat disclosed in U.S. Pat. No. 4,723,366, which is hereby incorporated herein by reference. That cleat includes a metal stud infrastructure having a vertical axis and two ends, a stem portion at a first end for engagement with a receptacle in a shoe, a head portion at a second end for tractive engagement with the ground, and a broad frustoconical flange between the stem and head portions and extending radially outwardly from the vertical axis. A plastic skirt is molded directly upon the flange portion of the metal infrastructure, the resultant unitary skirt and flange forming the reinforced radial support member of the cleat. Two wrench holes remain in the radial support member for engagement with a special insertion and removal wrench.

The invention is also pertinent to more conventionally formed cleats, virtually all of which suffer from the defect that they may become unscrewed from their receptacles in use. While the cleat of the foregoing patent offers a resilient plastic skirt as an aid to maintaining a lock on the threads of the engagement of the cleat, it is still possible under some circumstances for the cleat to work its way loose in its receptacle.

DISCLOSURE OF THE INVENTION

The present invention in a preferred embodiment provides a traction cleat having a cylindrical cuff disposed concentrically around the screw or other arrangement for engaging the cleat in the receptacle, wherein the cylindrical cuff has inner and outer surfaces and wherein an annular gap is defined between the engagement means and the cuff. The cylindrical cuff includes one or more axially oriented splines disposed on its inner or outer surface. Such a cleat may be attached to the shoe utilizing a receptacle, in accordance with a preferred embodiment of the invention, that has a cylindrical ring disposed concentrically around the cleat-receiving portion of the receptacle. The cylindrical ring has one or more axially oriented splines disposed on one of the ring's inner or outer surfaces in such a fashion as to be able to mesh with the spline or splines on the mated cleat.

BRIEF DESCRIPTION OF THE DRAWINGS

These and other features of the invention will be more readily understood by consideration of the following detailed description, taken with the accompanying drawings, in which.

DESCRIPTION OF SPECIFIC EMBODIMENTS

Figure 1:
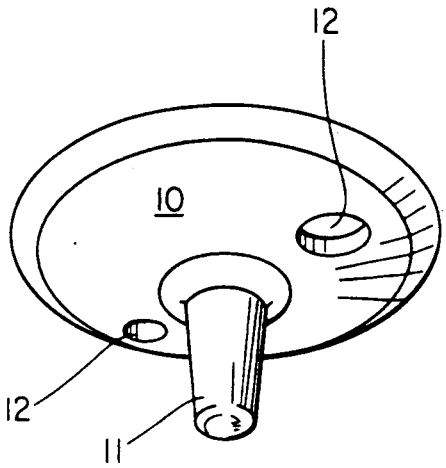
FIG. 1 is a perspective view from below of a preferred embodiment of a traction cleat in accordance with the invention.

As can be seen in FIG. 1, the invention is applicable to a wide range of cleats known in the prior art, including the traction cleat disclosed in the U.S. Pat. No. 4,723,366, which viewed from the bottom has a similar appearance. Evident are plastic skirt 10, the ground-engaging head portion 11 of the metal infrastructure of the cleat, and wrench holes 12.

Figure 2:
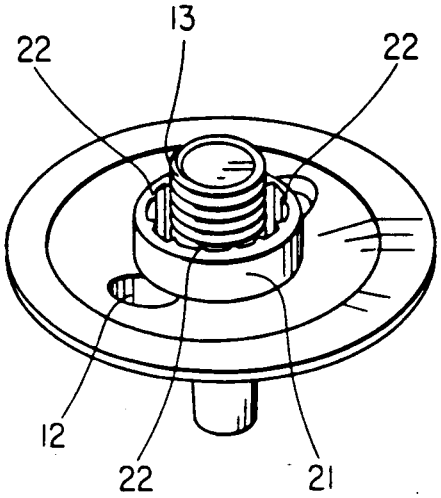
FIG. 2 is a perspective view from above of the embodiment of FIG. 1;.

As can be seen in FIG. 2, however, the cleat in the present invention includes not only the engagement means 13 (which in this case is a screw for engagement of the cleat removably with a suitable receptacle) but also a cylindrical cuff 21 on which are disposed a series of axially oriented splines 22. The cuff may be formed of any suitable material, including plastic or metal. In the event that the cuff is metal, it may be physically connected to the metal infrastructure of the cleat, and in the event that the cuff is plastic, it may be integrally formed with the skirt 10.

Figure 3:
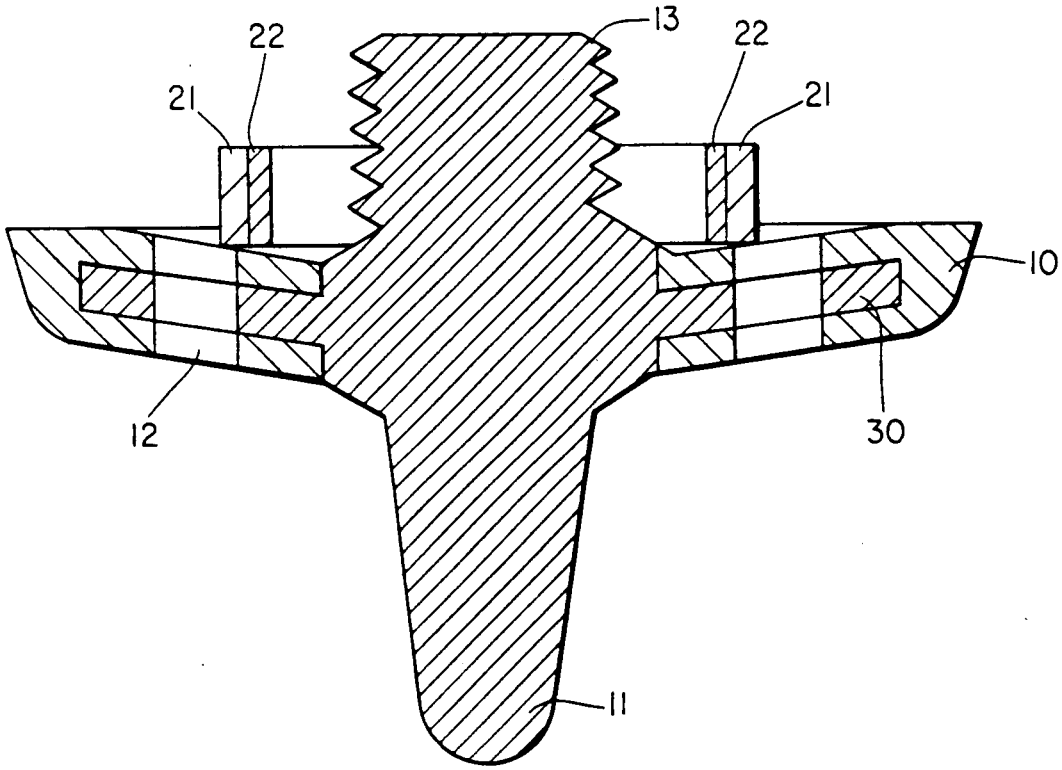
FIG. 3 is a vertical section of the embodiment of FIGS. 1 and 2.

The structure of the cleat of FIGS. 1 and 2 is shown in further detail in FIG. 3, presenting a vertical section of the cleat. The metal infrastructure includes the screw 13 and the ground-engaging head portion 11, as well as flange member 30. The flange member 30 reinforces skirt 10, and in this instance, the cuff 21 is integrally formed with the skirt 10. As fully illustrated in FIG. 2, the cylindrical cuff has inner and outer surfaces, and an annular gap is defined between the engagement means 13 and the cuff 21. The splines 22 are shown to be in the present case formed on the inside surface of the cuff 21. The sole plate 40, which is preferably made of plastic, of FIG. 4A has an array of receptacles 41 in accordance with the invention that are suitable for receiving cleats in accordance with those illustrated in FIGS. 1-3. Similarly, a heel plate can have an array of receptacles in accordance with the invention. Each receptacle 41 has one or more splines 42 axially disposed on the outer surface of a ring 43. The ring 43 is disposed concentrically around the threaded hole 44 of the receptacle. At its base 45 the receptacle is affixed to the sole plate 40.

Figure 4A:
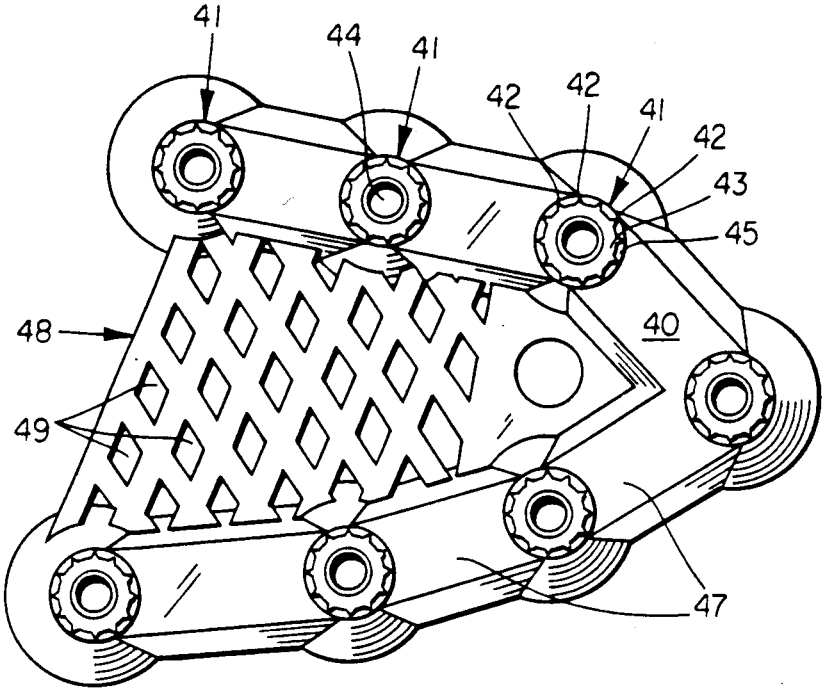
FIG. 4 is a view from below of a sole plate having an array of receptacles in accordance with a preferred embodiment of the invention.
FIG. 4B is a vertical section of a portion of the sole plate of FIG. 4A as embedded in a shoe sole.
FIG. 4C is a vertical section of a portion of a sole plate in accordance with FIG. 4A embedded in a sole, wherein a traction cleat in accordance with FIGS. 1-3 has been partially screwed into the receptacle shown.

In a preferred embodiment, the inner portion 48 of the sole plate 40 has a diamond pattern. This diamond pattern is formed by an array of diamond-shaped apertures 49. As shown in FIG. 4A, the diamond-shaped apertures 49 are disposed such that their longer axes are perpendicular to a line running from the toe to the heel, and their shorter axes are parallel to a line running from the toe to the heel. This arrangement makes the plate more flexible in a toe-to-heel direction, while giving good side-to-side support. This arrangement also makes the plate lighter than a solid plate. Furthermore, the array of apertures 49 makes the plate easier to manufacture; it allows a better flow of material during the molding process, thereby causing less rejects than if the plate was solid. The outer portions 47 of the sole plate 40 are preferably solid and thicker than the inner portion 48. This gives greater support to the receptacles 41. A heel plate can have a design similar to that of the sole plate shown in FIG. 4A.

Figure 4B:
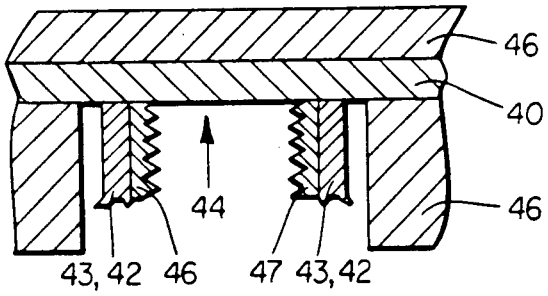

FIG. 4B is a vertical section of a portion of the sole plate of FIG. 4A as embedded in a shoe sole 46. The threads 50 and hole 44 of socket 47 are shown. The socket may preferably be metal, although plastic materials are also possible. In the event that the receptacle is metal, the ring 43 and splines 42 may be integrally formed therewith. Indeed, the socket and ring and splines may be integrally formed in any event, although it is convenient in many instances to make the socket 47 of metal and the ring 43 and splines out of plastic; these plastic components may be integrally formed with the plastic sole plate 40.

Figure 4C:
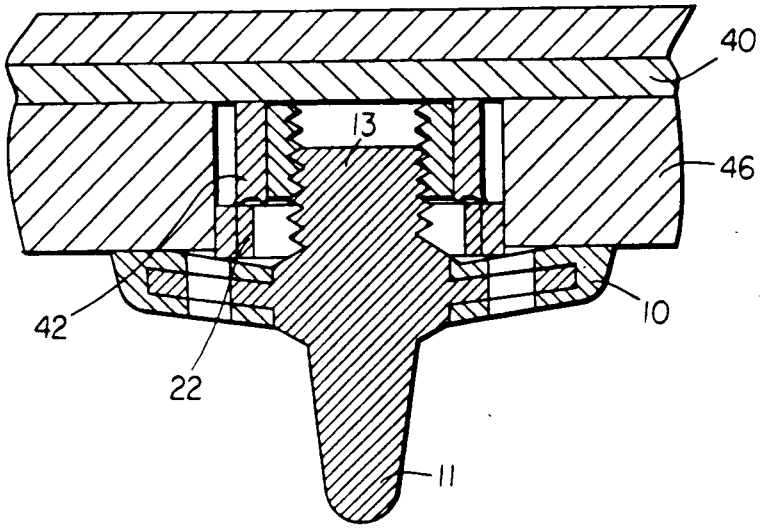

In FIG. 4C, a traction cleat in accordance with FIGS. 1-3 has been partially screwed into the receptacle shown. The receptacle has been screwed until the splines 42 of the ring 43 of the receptacle have just met the splines 22 of the cylindrical cuff 21 of the cleat. When the cleat is screwed in further, there will be some deformation of the sole 46 and of the plastic skirt 10, and the splines 42 of the ring will engage against the splines 22 of the cuff. The geometry of the splines is such that they will be subject to some deformation as the cleat is screwed into the threads 50 of the socket 47. The components are thus configured in such a way that the inside diameter of the cuff 21 is slightly greater than the outside diameter of the ring 43 including its spines 42. Because the splines have some resilience, after the deformation they will at least partially resume their former shape, and make it more difficult for the cleat to become unscrewed. We have found that in instances where the cuff, ring, and splines are formed of conventional plastics, excellent results obtain.

Figure 5A:
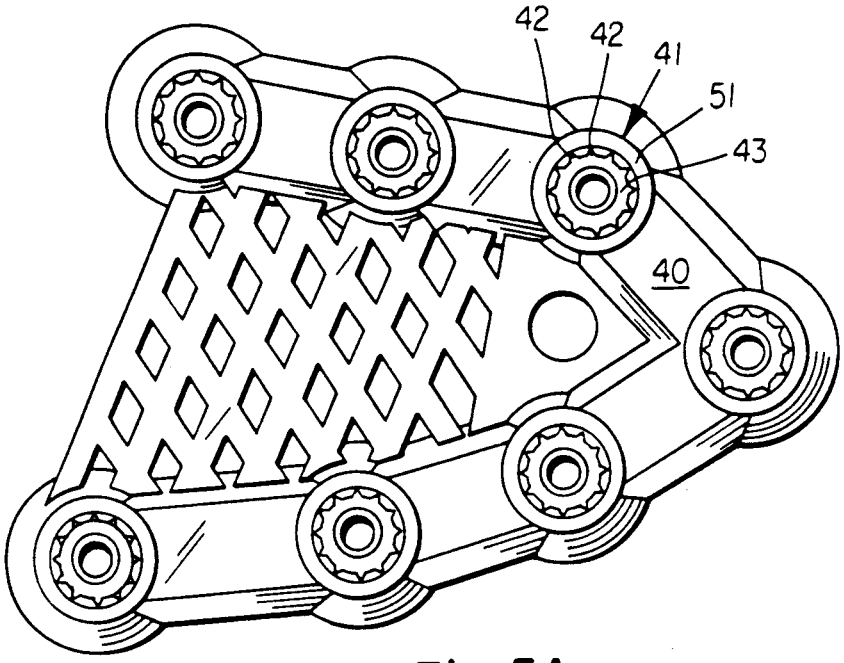
FIG. 5A is a view from below of a sole plate having an array of receptacles in accordance with another preferred embodiment of the invention.

FIG. 5A shows another preferred embodiment of the invention, wherein the receptacle 41 includes not only a first ring, 43 around the outside of which are axially disposed splines 42, but also an outer ring 51 having a smooth inside surface. The relation of the two rings is shown more clearly in FIG. 5B, in which a portion of the sole plate 40 of FIG. 5A is embedded in shoe sole 46. The outer ring 51 helps delineate the minimum hole diameter in the sole 46 to permit the receptacle to be accessible through the hole. In other words, the sole clearance space 52 on either side of outer ring 51 can be infinitessimally small, without interfering with access to the receptacle.

Figure 5B:
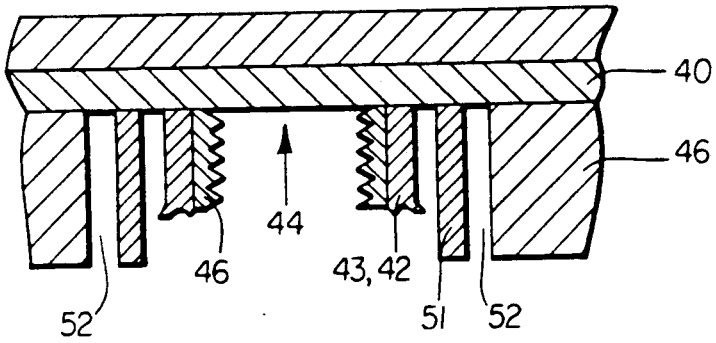
FIG. 5B is a vertical section of a portion of the sole plate of FIG. 5A as embedded in a shoe sole.
Figure 5C:
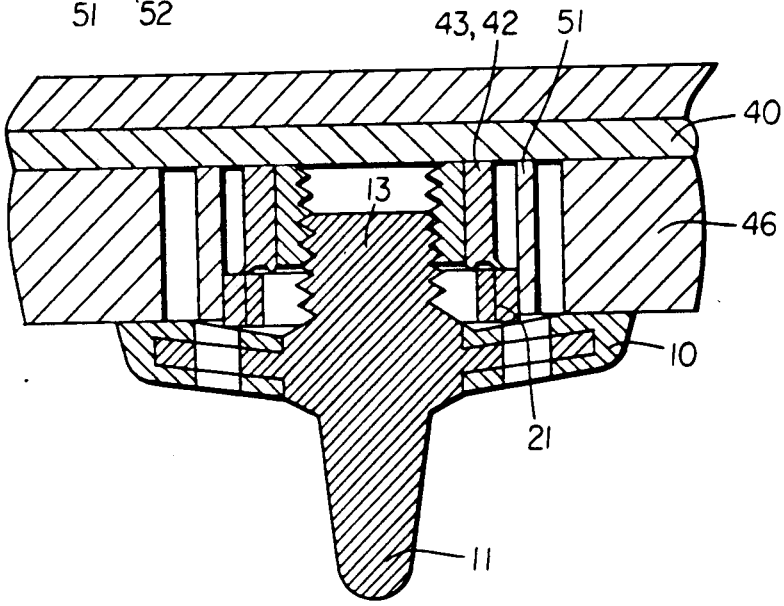
FIG. 5C shows a vertical section of a portion of a sole plate in accordance with FIG. 5A embedded in a sole, wherein a traction cleat in accordance with FIGS. 1-3 has been partially screwed into the receptacle shown.

FIG. 5C shows the receptacle of FIG. 5B used for receiving a cleat in accordance with FIGS. 1-3. The action of the cuff 21, ring 43, and their respective splines is as discussed in connection with FIG. 4C. Additionally, however, outside ring 51 lies on the outside of cuff 21 and serves as a seal against water and other ,elements otherwise leaking into the threaded areas 13 and 50 of the cleat and receptacle.

Figure 6A:
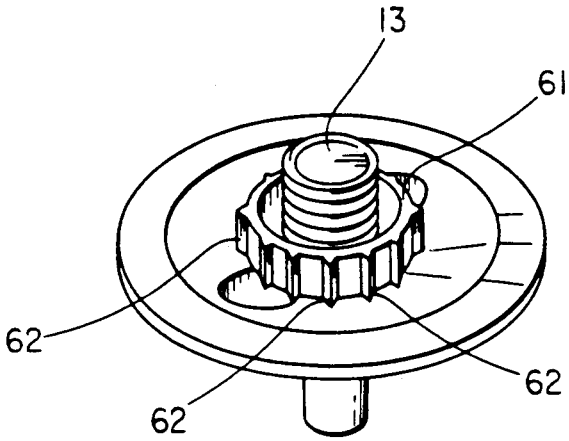
FIG. 6A is a perspective view from the bottom of another preferred embodiment of a traction cleat in accordance with the invention.

As can be seen in FIG. 6A, the cuff 61 associated with the cleat may have splines 62 disposed axially around the outside of the cuff instead of around the inside of it. Such an arrangement may work in equivalent fashion to that described above in connection with the preceding figures, assuming that the receptacle is suitably modified.

Figure 6B:
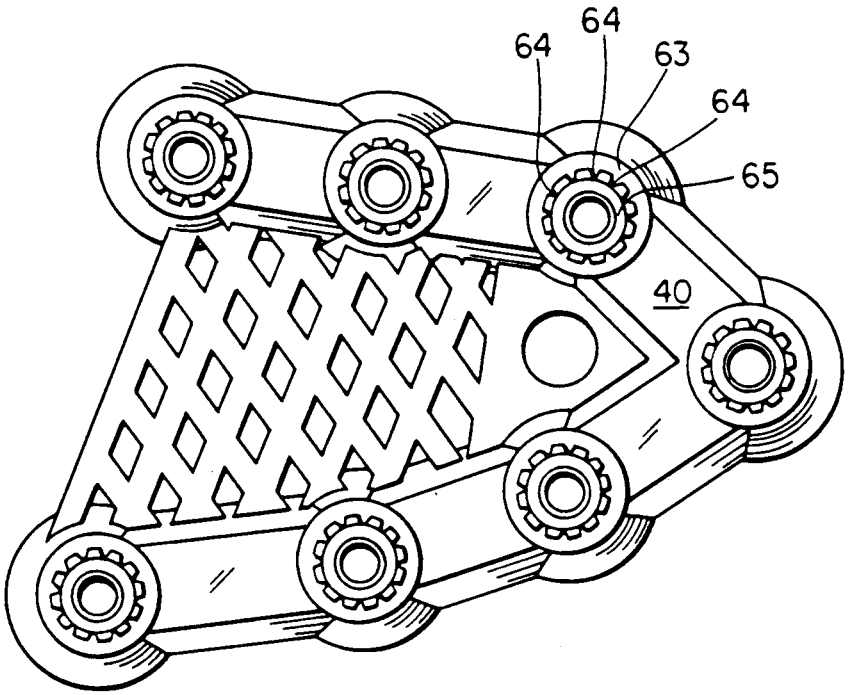
FIG. 6B is a view from below of a sole plate containing an array of receptacles in accordance with the invention that are suitable for use with the cleat embodiment shown in FIG. 6A.

FIG. 6B shows such a modification of the receptacle. In this embodiment, the outer ring 63 is provided with splines 64 on the inside surface thereof. An inner ring 65 having a smooth outer surface is also shown. (The inner ring is not to scale, and the outside wall of the inner ring should in fact be drawn to leave space between the splines 64 and the inner ring 65.) In accordance with the invention, when the cleat of FIG. 6A is mated with the receptacle of FIG. 6B, the cuff 61 is designed in relation to the two rings of the receptacle in such a way that it falls between the two rings, the outside of the inner ring engaging against the inside of the cuff, and the splines of the outer ring engaging against the splines 62 outside of the cuff 61.

What is claimed is:

1. A traction cleat for removable attachment to the underside of footwear, the cleat comprising:

(a) an axial member, having a vertical axis and first and second ends, and including:

i. at the first end, engagement means for removable engagement with a mated receptacle, ii. a cylindrical cuff disposed concentrically around the engagement means and having inner and outer surfaces, wherein an annular gap is defined between the engagement means and the cuff, iii. an axially oriented spline disposed on one of the cuff's inner and outer surfaces in such fashion as to be able to mesh with a similar spline on the mated receptacle, and iv. at the second end, a ground-engaging head portion; and (b) a support structure extending radially outward from a region between the engagement means and the head portion along the vertical axis.

2. A traction cleat according to claim 1, further comprising a plurality of axially oriented splines disposed on one of the cuff's inner and outer surfaces.

3. A traction cleat according to claim 2, wherein the splines are disposed on the cuff's inner surfaces.

4. A traction cleat according to claim 2, wherein the splines are disposed on the cuff's outer surface.

5. A traction cleat according to claim 2, further comprising:

(a) a metal infrastructure that includes the engagement means, the head portion, and a flange member extending radially outward from a region between the engagement means and the head portion along the vertical axis; and (b) a plastic flange-supporting skirt substantially encasing the flange member and forming with the flange member the support structure;

wherein the cuff is affixed to the skirt.

6. A traction cleat according to claim 5, wherein the cuff is integrally formed with the skirt.

7. A receptacle for a traction cleat comprising:

(a) a base for affixing the receptacle to the sole of a shoe;

(b) receiving means affixed to the base for removably engaging a member of a mated traction cleat;

(c) a first cylindrical ring disposed concentrically around the receiving means and having inner and outer surfaces; and (d) a second cylindrical ring disposed concentrically around the engagement means, so that one of the first and second rings is outside of the other, and the outside ring serves to delineate the boundary of the hole in the sole; and (e) a plurality of axially oriented splines disposed on one of the first ring's inner and outer surfaces in such fashion as to be able to mesh with similar splines on the mated traction cleat.

8. A receptacle according to claim 7, wherein the outside ring is so dimensioned as to form a seal when there is mated with the receptacle a traction cleat having (i) engagement means for removable engagement with the receptacle and (ii) a cylindrical cuff disposed concentrically around the engagement means, the seal being formed between the outside ring and the cylindrical cuff.

9. A plate comprising an array of receptacles, wherein each receptacle is constructed in accordance with claim 8.

10. A plate comprising an array of receptacles, wherein each receptacle is constructed in accordance with claim 7.

* * * * *